US006461684B1

(12) United States Patent
Huang et al.

(10) Patent No.: US 6,461,684 B1
(45) Date of Patent: Oct. 8, 2002

(54) SPRAY COATING ONTO WIRES

(75) Inventors: Yen How Huang, Solon, OH (US); Eddie Franklin Riggenbach, Rootstown, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 0 days.

(21) Appl. No.: 09/965,923

(22) Filed: Sep. 28, 2001

(51) Int. Cl.[7] ..... B05D 1/02

(52) U.S. Cl. ..... 427/424; 118/313

(58) Field of Search ..... 427/424; 118/313

(56) References Cited

U.S. PATENT DOCUMENTS

| | | | | |
|---|---|---|---|---|
| 4,174,678 | A | 11/1979 | Van Den Bergh | 118/307 |
| 4,406,114 | A | 9/1983 | Lanier et al. | 57/7 |
| 4,634,603 | A | 1/1987 | Gruss et al. | 427/96 |
| 5,592,927 | A | 1/1997 | Zaluzec et al. | 123/668 |

*Primary Examiner*—Bernard Pianalto
(74) *Attorney, Agent, or Firm*—Nancy T. Krawczyk

(57) ABSTRACT

A spray coating process combines an oil mix spray unit with a low air pressure nozzle to deliver minute quantities of ultra-fine spray of corrosion inhibitor onto a wire surface during a wire processing step. Utilizing a low air pressure nozzle, corrosion inhibitor may be sprayed at a pressure less than one pound per square inch, preventing the formation of spray mist. This system enables an accurate, clean delivery of corrosion inhibitor fluids to the steel cord surface without environmental contamination.

7 Claims, 2 Drawing Sheets

SPRAY COATING ONTO WIRES

FIELD OF THE INVENTION

The present invention is directed toward a method of spray coating wires. More particularly, the present invention is directed toward applying a corrosion inhibitor to wires using a low pressure nozzle to achieve a desired spray.

BACKGROUND OF THE INVENTION

Manufacturers of rubber reinforced articles have long realized the importance of applying corrosion inhibitors to metal reinforcement portions of the article. Corrosion inhibitor coating not only improves the corrosion resistance of the metal reinforcement, but, when the metal reinforcement is present in the form of a cord, the corrosion inhibitor also enables a complete rubber-penetration in towards the central wire of the cord. A complete rubber penetration about the central wire not only improves the resistance of corrosion propagation but also effectively extends the fatigue life expectation of the steel cord.

The corrosion inhibitor is usually present in oil in a preferred percentage by weight and the oil mix is applied to the metal reinforcement. Contacting the oil mix to the cord to be treated is conventionally accomplished by spraying, brushing, doctor blade, dipping, wicking and the like. For example, oil mixtures can be applied by dipping the cord into the oil mix and using a mechanical or air wipe to control the desired amount of chemical mix on the cord. The oil mix can also be applied by wicking or rubbing the cord against a material that transfers the oil mix. This procedure is subject to variable concentration on the cord.

The application processes can be incorporated after the cabling of the wire but preferably the oil mix is applied to the wire filaments during the cabling, bunching or spiral wrapping process. In addition, the oil mix can be applied just before a rubber/steel cord calendering operation. The calendering operation is the step when the treated cord is embedded between two layers of the rubber and pressed to form the metallic reinforced rubber ply. The calendering step is well known to those skilled in the art.

In order to apply corrosion inhibitor technology in the wire processing line or in the tire production line, a well-defined corrosion inhibitor coating process is needed.

SUMMARY OF THE INVENTION

In the present invention, a spray coating process combines an oil mix spray unit with a low air pressure nozzle to deliver minute quantities of ultra-fine spray of corrosion inhibitor onto a wire surface during a wire processing step. Using the low air pressure nozzle, corrosion inhibitor can be sprayed at a pressure less than one pound per square inch. This system enables an accurate, clean delivery of corrosion inhibitor fluids to the steel cord surface without environmental contamination.

Disclosed is a method of coating a wire with a corrosion inhibitor. The method employs the steps of passing a wire over a pulley and applying a spray of an oil mixture onto the wire. The oil mixture contains at least the desired corrosion inhibitor. To form the ultra-fine spray, the spray is applied at an air pressure in the range of less than 1 to 15 psi.

In a further aspect of the invention, the ultra-fine spray applied to the wire is formed of oil mixture droplets having a maximum diameter of $10^{-5}$ to $10^{-4}$ meters.

In another aspect of the invention, the oil mixture is applied by bringing together an oil mixture feed line, supplied at a pressure of 50 to 100 psi, and an air feed line, supplied at a pressure of less than 1 to 15 psi.

In another aspect of the disclosed method, the wire is passed about a pair of pulleys. Each pulley has an associated low pressure spray nozzle.

In another aspect of the disclosed method, the wire passes through a groove in the pulley. Coating of the portion of the wire adjacent the pulley groove with the corrosion inhibitor is aided by any oil mixture present in the pulley groove.

DEFINITIONS

Cord: means one or more of a reinforcing element, formed by one or more filaments or wires which may or may not be twisted or otherwise formed. Therefore, cords may comprise from one (monofilament) to multiple filaments. The number of total filaments or wires in the cord may range from 1 to 134. Preferably, the number of filaments or wires per cord ranges from 1 to 49.

Cord Constructions: means a winding arrangement of a number of filaments or wires to form a cord. The number of cord constructions which can be treated according to the present invention are numerous. Representative examples of such cord constructions include 2×, 3×, 4×, 5×, 6×, 7×, 8×, 11×, 12×, 27×, 1+2, 1+3, 1+4, 1+5, 1+6, 1+7, 1+8, 1+14, 1+15, 1+16, 1+17, 1+18, 1+19, 1+20, 1+26, 2+1, 2+2, 2+5, 2+6, 2+7, 2+8, 2+9, 2+10, 2/2, 2/3, 2/4, 2/5, 2/6, 3+1, 3+2, 3+3, 3+4, 3×4, 3+6, 3×7, 3+9, 3/9, 3+9+15, 4+3, 4×4, 5/8/14, 7×2, 7×3, 7×4, 7×7, 7×12, 7×l9, 5+1, 6+1, 7+1, 8+1, 11+1, 12+1, 2+7+1, 1+4+1, 1+5+1, 1+6+1, 1+7+1, 1+8+1, 1+14+1, 1+15+1, 1+16+1, 1+17+1, 1+18+1, 1+19+1, 1+20+1, 2+2+8, 2+6+1, 2+7+1, 2+8+1, 2+9+1, 2+10+1, 2+2+8+1, 3+9+15+1, 27+1, 1+26+1, 7×2+1, 3+9+1, 3/9+1, 7×12+1 and 7×19+1. The filaments in the cord constructions may be preformed, waved or crimped. The preferred cord constructions include 2×, 3×, 1+5, 1+6, 1+18, 2+7, 3+2, 3+3 and 3/9+1.

Metallic cord: means a steel, zinc-plated steel or brass-plated steel cord.

Oil Mix: means a oil containing a corrosion inhibitor. The oil mix has a kinematic viscosity of 460–9200 cSt (460–9200 $mm^2/s$) at room temperature.

Steel: means a steel substrate derived from conventional processes known to those skilled in the art. For example, the steel used for wire may be conventional tire cord rod including AISI grades 1070, 1080, 1090 and 1095. The steel may additionally contain varying levels of carbon and microalloying elements such as Cr, B, Ni and Co.

Wire Diameter: means the diameter of an individual wire or filament that is encapsulated or used in a cord. For steel cords used in manufacturing tires, the wire diameter may range from about 0.08 to 0.5 mm. Preferably, the diameter ranges from 0.15 to 0.42 mm.

BRIEF DESCRIPTION OF THE DRAWINGS

The invention will be described by way of example and with reference to the accompanying drawings in which.

DETAILED DESCRIPTION OF THE INVENTION

The present invention specifically refers to the coating of wire cords to be used in the manufacturing of tires. However, it should be appreciated that the spray coating method and apparatus disclosed can be used for the coating of any wires or wire cords that may be used in the manufacture of other types of finished articles. Coating assemblies in accordance with the present invention are illustrated in FIGS. 1 and 2.

Figure 1:
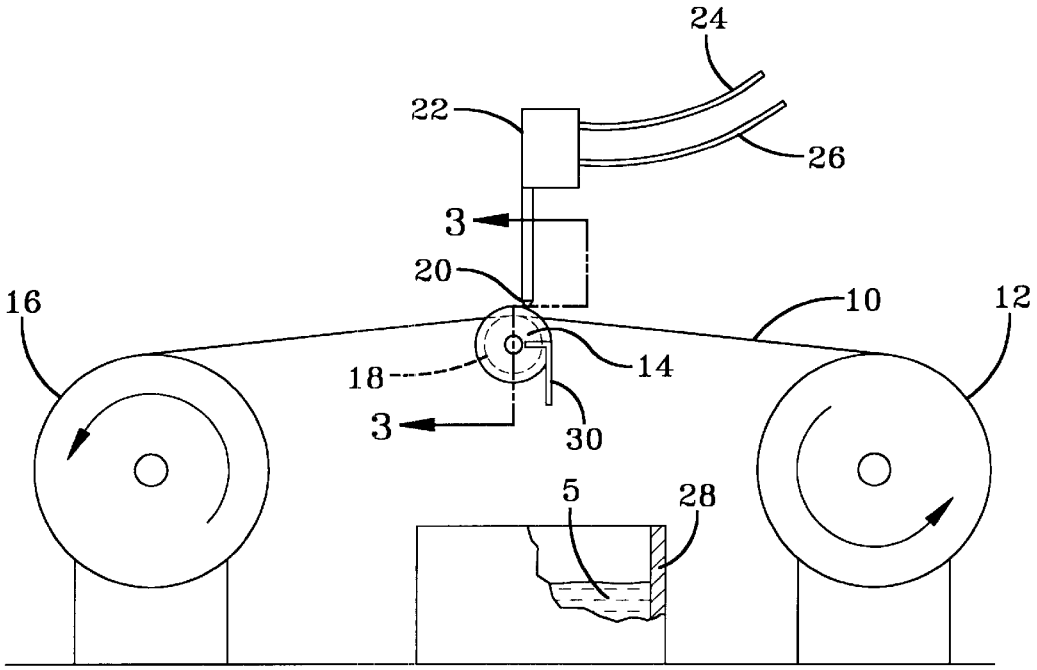
FIG. 1 is a single nozzle/pulley spray coating assembly.
Figure 2:
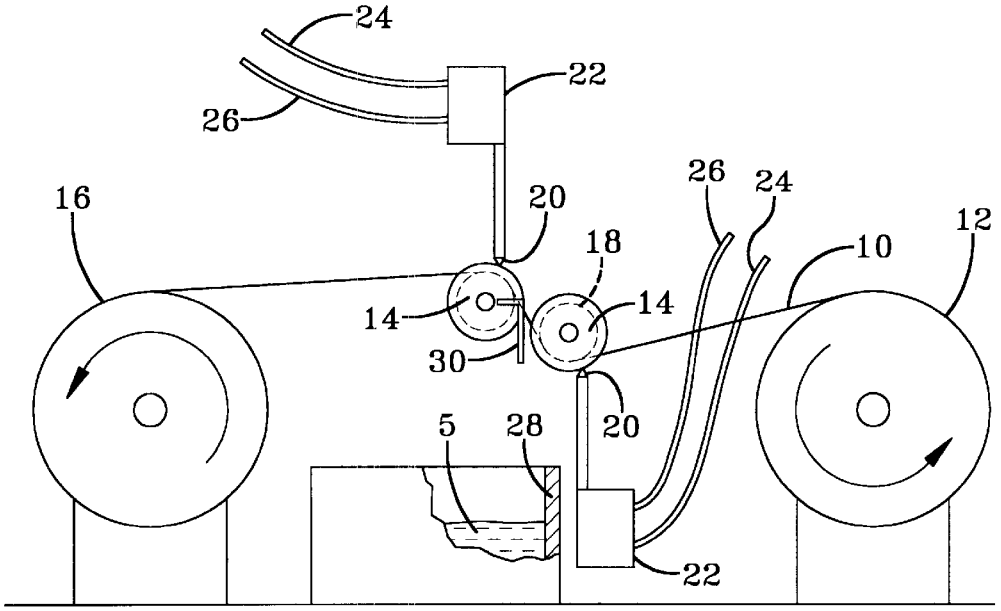
FIG. 2 is a dual nozzle/pulley spray coating assembly.

Referring now to the assembly in FIGS. 1 and 2, the wire 10 to be coated is initially located on a pay-off roll 12. The wire 10 may be an individual filament or a cord. If the wire 10 is to be used in tire manufacturing, the diameter ranges from 0.08 to 0.5 mm. The roll 12 rotates in the direction shown, the wire 10 passes over a pulley 14, and is wound onto the take-up roll 16. Since the wire 10 may be coated at any stage of formation or processing, the illustrated pay-off and take-up rolls 12, 16 are merely illustrative of a initial and final location of the wire 10 prior to and following the coating application.

Figure 3:
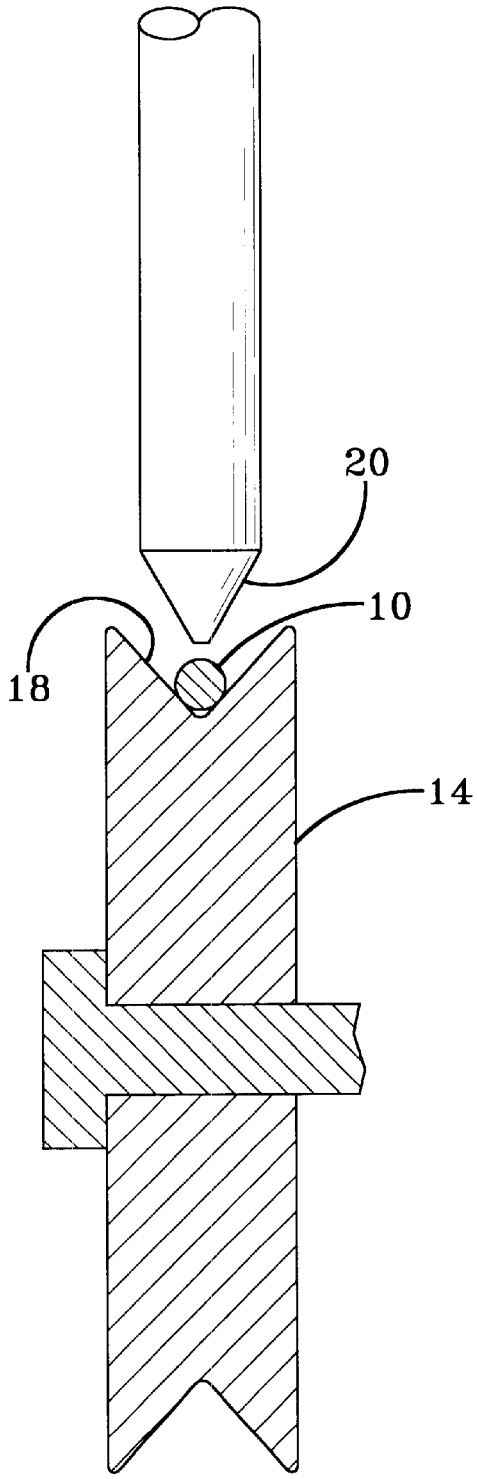
FIG. 3 is a cross-sectional drawing taken along line 3—3 of FIG. 1.

The pulley 14 has a central groove 18 in which the wire 10 travels, see FIG. 3. The pulley 14 plays several important roles in the spraying process. First, the pulley 14 stabilizes the wire position so that the spray nozzle 20 can point closely to the wire 10 without any risk of spray head damage by any wire vibration. Second, the pulley 14 can collect any "strayed" oil mix 5 in the groove 18 to rub-coat the other side of the wire 10.

Adjacent to the pulley 14 is an oil mix spray unit 22. Entering into the unit 22 is an oil mix supply line 24 and an air supply line 26. Exiting the oil mix spray unit is the spray nozzle 20. The oil mix 5 is fed through the oil mix supply line 24 at a relatively high pressure, from 50 to 100 psi. The oil mix pressure is preferably 65 to 85 psi. The oil mix 5 contains the desired corrosion inhibitor. The air is supplied through the air supply line 26 at a relatively low pressure, from less than 1 psi to 15 psi, preferably 1 to 8 psi.

The spray nozzle 20 exiting the oil mix spray unit 22 is a low air pressure nozzle, operating at pressures as low as less than one pound per square inch (psi). The nozzle 20 preferably is operated at a pressure within the range of less than 1 psi to 15 psi. The nozzle 20 is located adjacent to the pulley groove 18. The spray nozzle 20 is arranged in a way that the oil mix 5 is sprayed directly onto the wire 10 at a location near the pulley 14, but not on the pulley 14. With the low pressure spray nozzle 20 and the low air pressure used, minute quantities of an ultra-fine spray of corrosion inhibitor are continuously applied on the wire 10. The oil mix droplets have a maximum diameter varying from $10^{-5}$ to $10^{-4}$ meter.

Located beneath the pulley 14 is a recycle container 28. Any oil mix 5 that does not adhere to the wire 10 or remain in the pulley groove 18 is received in the recycle container 28. The oil mix 5 is returned to the oil mix feed line 24 and, if needed, is filtered prior to returning to the oil mix feed line 24. A wiper 30 located along the pulley 14 may aid in the recycling of the oil mix 5.

In the single pulley apparatus of FIG. 1, only one side of the wire 10 is coated. However, due to the oil mix 5 in the pulley groove 18 and the wetting capability of the corrosion inhibitor itself, the other side of the wire 10 can also be covered with the corrosion inhibitor during the process of pulling the wire 10 through the pulley groove 18.

The use of two pulleys 14, as seen in FIG. 2, increases the coating uniformity on both sides of the wire 10. While not illustrated, the number of spray heads 20 along the pulley 14 can be increased if a higher amount of corrosion inhibitor were needed, for larger wires 10 for example.

The applicator can be placed at any location along the cord production line. Since the amount of corrosion inhibitor needed in different production lines may vary widely form time to time, and the amount of corrosion inhibitor needed for a single production line may also vary, the sprayer unit can be arranged in a way that either a single nozzle or a multiple nozzle assembly may be used.

The use of the directional, ultra-fine, non-misting corrosion inhibitor sprayer reduces the amount of corrosion inhibitor used as a more precise amount of inhibitor is used and more precisely placed on the wire 10. This results in a decrease of inhibitor consumption and contamination, and eliminates under and over coating of inhibitor. This system also eliminates environmental contamination typically caused by stray mist generated by conventional spray coating apparatus.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

What is claimed is:

1. A method of coating a wire with a corrosion inhibitor, the method comprising the steps of:

passing a wire over a pulley; and applying a spray of an oil mixture onto the wire, the oil mixture containing a corrosion inhibitor, the spray being applied at an air pressure in the range of less than 1 to 15 psi.

2. A method of coating a wire in accordance with claim 1 wherein the spray is comprised of oil mixture droplets having a maximum diameter of $10^{-5}$ to $10^{-4}$ meters.

3. A method of coating a wire in accordance with claim 1 wherein the oil mixture is supplied at a pressure of 50 to 100 psi and combined with air being supplied at a pressure of less than 1 to 15 psi.

4. A method of coating a wire in accordance with claim 1 wherein the spray is applied at an air pressure of 1 to 5 psi.

5. A method of coating a wire in accordance with claim 1 wherein the wire is passed about a pair of pulleys.

6. A method of coating a wire in accordance with claim 1 wherein the method is further comprised of passing the wire through a groove in the pulley.

7. A method of coating a wire in accordance with claim 1 wherein at least a pair of nozzles apply the spray of oil mixture onto the wire.

* * * * *